United States Patent [19]

Tarozzi et al.

[11] Patent Number: 4,550,864

[45] Date of Patent: Nov. 5, 1985

[54] LEAK-PROOF DISPENSING CONTAINER

[75] Inventors: R. A. Tarozzi, Gales Ferry; C. Formhals, Ledyard, both of Conn.

[73] Assignee: King-Seeley Thermos Co., Norwich, Conn.

[21] Appl. No.: 181,730

[22] Filed: Aug. 27, 1980

[51] Int. Cl.[4] ..... B67D 5/42

[52] U.S. Cl. ..... 222/209; 222/400.8; 222/401; 222/484; 222/532

[58] Field of Search ..... 222/209, 400.8, 401, 222/484, 532

[56] References Cited

U.S. PATENT DOCUMENTS

| | | | |
|---|---|---|---|
| 1,968,316 | 7/1934 | Schmitt | 222/401 X |
| 2,992,763 | 7/1961 | Huertas | 222/484 |
| 3,223,296 | 12/1965 | Waddington et al. | 222/484 X |
| 3,447,724 | 6/1969 | Fiddyment | 222/484 X |
| 4,274,562 | 6/1981 | Medeiros et al. | 222/401 |

FOREIGN PATENT DOCUMENTS

| | | | |
|---|---|---|---|
| 561087 | 7/1923 | France | 222/401 |

*Primary Examiner*—Joseph J. Rolla
*Assistant Examiner*—Frederick R. Handren
*Attorney, Agent, or Firm*—Harness, Dickey & Pierce

[57] ABSTRACT

An insulated dispensing container that includes an air pump for generating pressure above the liquid in the container for selective discharge through the discharge nozzle. A valve arrangement is incorporated for preventing the accidental discharge or leakage of the container contents when the pump is not being operated. The discharge valve is provided with a venting arrangement to vent any built up pressure over the liquid in the container upon opening of the valve so as to prevent drippage.

8 Claims, 4 Drawing Figures

29
14
27
36
26
32
28
35
31
13
33
15
53
37
39
57
34
55
38
59
49
54
62
61
44
25
58
24
41
45
47
23
42
19
43
11
21
22
12
17
18
16

LEAK-PROOF DISPENSING CONTAINER

BACKGROUND OF THE INVENTION

This invention relates to a dispensing container, and more particularly to an improved valve arrangement for such container which prevents accidental fluid drippage.

Dispensing insulated containers embodying air pumps for assisting in the discharge of the liquid contents are well known. Such devices normally include a manually operated air pump that generates air pressure over the liquid in the container for delivery through a discharge spout. In order to provide assurances that liquid will not be inadvertently discharged, it has been proposed to provide a valve arrangement which both precluded communication of the pump with the container and of the delivery tube with the discharge nozzle when the valve is in its closed position. With such arrangement, it has been found in some isolated instances that minor drippage may occur when the valve is opened due to the build up of pressure in the container during the period when the valve was closed.

It is, therefore, a principle object of this invention to provide an improved valve arrangement for a dispensing container.

It is another object of this invention to provide a venting valve for a dispensing container of the type including a air pump.

SUMMARY OF THE INVENTION

This invention is adapted to embody a dispensing container that has a body portion which defines a cavity for containing a liquid. Pump means are carried by the body portion, which pump means has an outlet port in connection with the cavity for generating a pressure on the liquid contained therein upon operation of the pump means. Dispensing means are provided for delivering liquid from the cavity upon activation of the pump means. Valve means are also incorporated, moveable between a closed position, an intermediate position, and an open position. The valve means is effective to close communication of the outlet port with the cavity and to prevent liquid passage through the dispensing means when the valve means is in its closed position. In accordance with the invention, the valve means also includes a vent means for venting the area of the liquid in the cavity to the atmosphere at a restricted rate when the valve means is in its intermediate position for precluding accidental leakage of fluid due to pressure build up in the container when the valve means is moved toward its open position.

DETAILED DESCRIPTION OF THE PREFERRED EMBODIMENT

Figure 2:
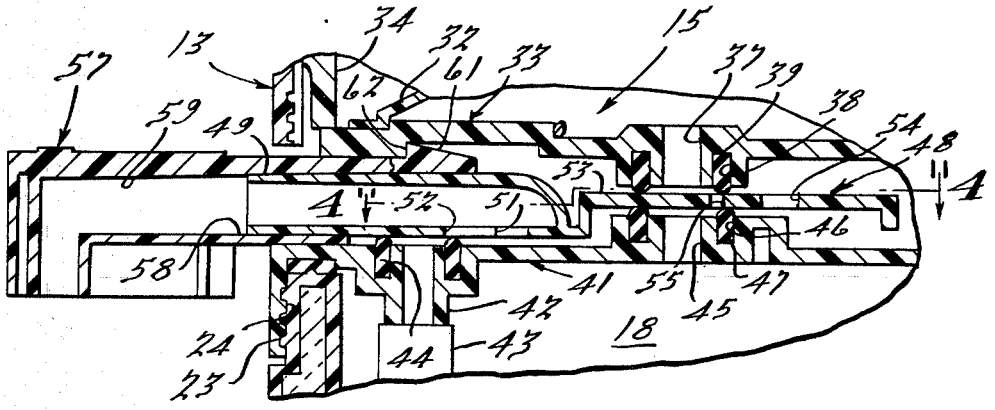
FIG. 2 is an enlarged cross-sectional view of the container in FIG. 1 showing the construction of the dispensing valve in its venting position.

An insulated dispensing container embodying this invention is identified generally by the reference numeral 11. The container 11 includes a body portion, indicated generally by the reference numeral 12, a closure, indicated generally by the reference numeral 13, a pump assembly, indicated generally by the reference numeral 14 and a dispensing valve arrangement, indicated generally by the reference numeral 15. The valve arrangement 15 and its operation is shown in more detail in FIGS. 2 thru 4.

The body portion 12 is comprised of a double walled jacket consisting of an outer wall 16 and an inner wall 17 which defines an internal cavity 18. The walls 16 and 17 are connected at their upper end by means of overlapping portions 19 and 21 that are connected to each other by means of a snap fit, spin welding or the like. An insulating medium such as a foamed plastic 22 is positioned in the area between the walls 16 and 17 so as to maintain the liquid in the cavity 18 at the desired temperature. Rather than the foam plastic 22 the space between the walls 16 and 17 may be filled with other types of insulations, such as a vacuum filler or other insulators.

The upper end of the body portion 17 is provided with male threads 23 so as to receive a female threaded portion 24 of the closure 13. A gasket 25 is positioned between a horizontal upper shoulder of the jacket 12 and the closure 13 so as to effect an air tight seal between these two components.

In order to provide for dispensing of liquid from within the cavity 18 the pump 14 selectively pressurizes the cavity 18 above the liquid level therein, as will become apparent.

The closure 13 includes an outer body 26 that has a re-entrant flange 27 which defines a cylindrical opening 28. A pump actuator in the form of an inverted cup 29 is slidably supported in the cavity 28. The pump actuator 29 has an outwardly extending flange 31 at its lower end which limits the degree of upward movement of the actuator 29.

Figure 1:
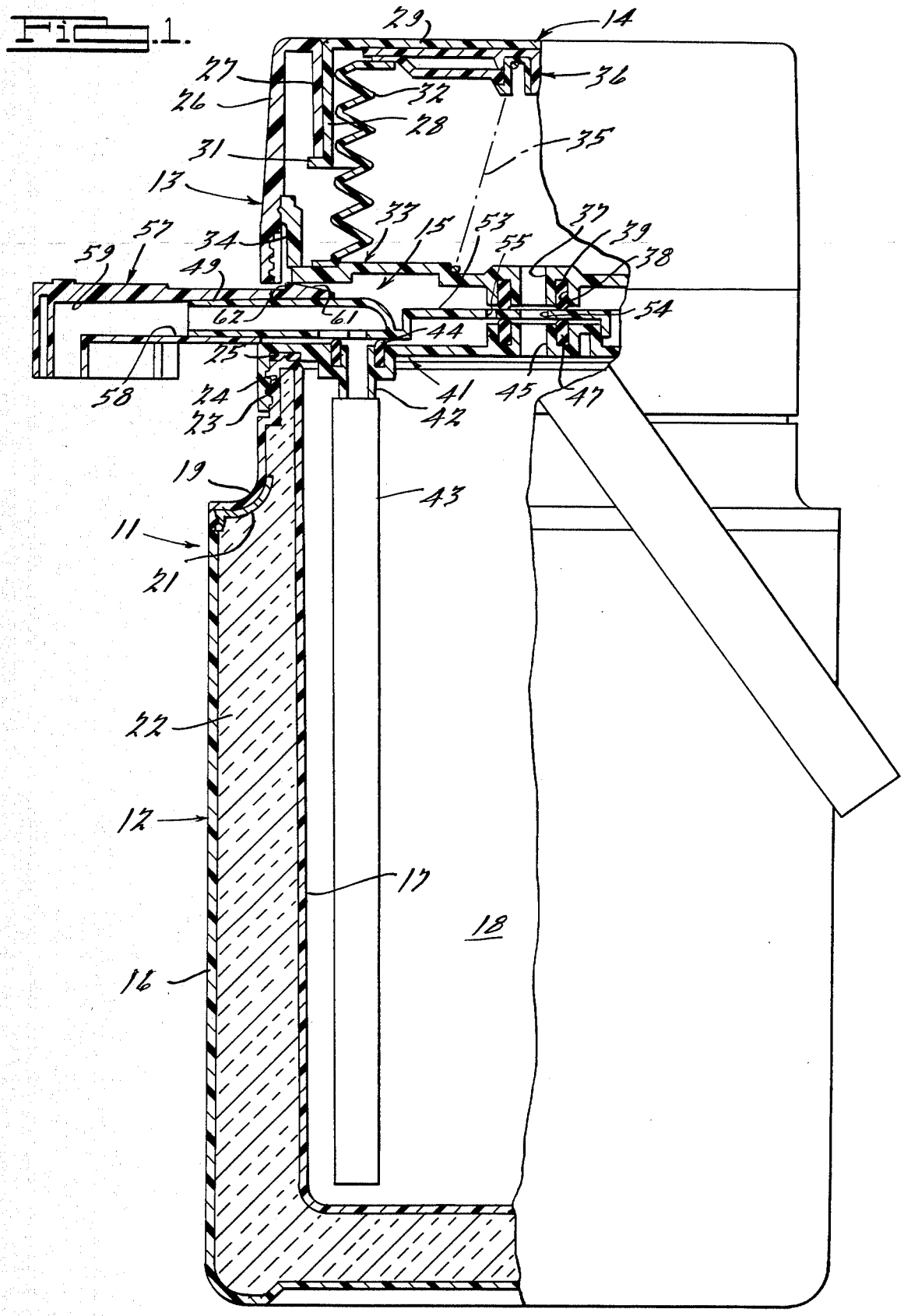
FIG. 1 is a side elevational view with portions of a dispensing container embodying this invention and showing the dispensing valve in its discharge position.

The pump actuator 29 bears against the upper end of a bellows 32 which is contained between the pump actuator and a plate 33 that is contained within the closure member 13. The plate 33 has an upstanding portion 34 that is affixed in any known manner to outer housing 26. A conical compression spring 35 is contained within the bellows 32 and urges the bellows 32 to its distended position as shown in FIG. 1.

A check type valve, indicated by the reference numeral 36, is provided so as to selectively admit air into the interior of the bellows 32 on the return stroke of the pump 14. This air is introduced through the clearance between the cavity 28 and the pump actuator 29. The plate 33 has a central aperture 37. The lower surface of the plate is formed with a recess 38 in which a sealing grommet 39 is positioned. The central opening 37 permits communication between the interior of the bellows 32 and the area above the liquid in the container cavity 18 so as to generate a pressure over this liquid when the pump actuator element 29 is depressed, as will become apparent.

The female threaded portion 24 of the closure 13 is formed in a plate assembly, indicated generally by the reference numeral 41, which forms the lower portion of the closure 13, the dispensing device and a portion of the valve 15. The plate 41 has a depending cylindrical portion 42 onto which a dispensing tube 43 is pressed. The tube 43 extends to the lower portion of the cavity 18 so that it will be below the liquid in the cavity 18 until substantially all of the liquid has been expelled from this cavity. At the upper end of the cylindrical portion, and on the upper side of the plate 41, an annular recess is formed which receives a seal 44. The seal 44 cooperates with the valve 15 so that when the cavity 18 is pressurized the liquid will be forced up through the tube 43 and cylindrical portion 42 for discharge in a manner to be described.

The plate 41 has a central opening 45 that is aligned with the upper plate opening 37 so as to permit air under pressure to flow into the cavity 18 when the pump 14 is actuated. The central opening 45 is surrounded, on its upper surface, by means of a circumferential groove 46 in which a seal 47 is received.

The valve arrangement 15 includes a slide valve element, indicated generally by the reference numeral 48, which includes a cylindical discharge portion 49. The discharge part 49 has a passage which extends from a downwardly facing opening 51, which is, at times, adapted to register with the opening in the cylindrical portion 42 so that liquid may be delivered from the tube 43 and discharged as will become apparent. Adjacent the discharge end of the portion 49, the opening 51 is provided with a narrow venting opening 52, so that the openings 51 and 52 form a key-hole shaped opening which cooperates with the opening above the cylindrical portion 42.

Rearwardly of the opening 51, the slide valve 48 is provided with a horizontally extending part 53 which is disposed between the seal 39 of the plate 33 and the seal 47 of the plate 41. The portion 53 is formed with a circular air passage 54, which is generally of the same diameter as the passages 37 and 45. Between the opening 51 and the passage 54, the part 53 is formed with a dumbbell shaped opening 55. The slide valve 48 is slideably supported in any suitable manner between the plates 33 and 41.

A discharge spout, indicated generally at 57, has a cylindrical bore 58 which is press-fitted on to the outer end of discharge portion 49 of the slide valve 48. A discharge passage 59 extends through the spout 57 in fluid communication with the discharge portion 49 so as to direct the liquid from the container cavity 18 downwardly into an awaiting receptacle when in operation.

A venting stop consisting of a cantilever tab 61 is formed integrally with the spout 57 and extends upwardly therefrom. The tab 61 has a forwardly facing stop surface 62 which is adapted to engage a shoulder 63 when the valve assembly 15 is in its venting position. In order to place the valve 15 in its discharge position, the tab 61 is depressed so that the surfaces 62 and 63 will be clear of each other and so that the spout 57 may be drawn outwardly to its discharge position, as will become apparent.

OPERATION

Figure 3:
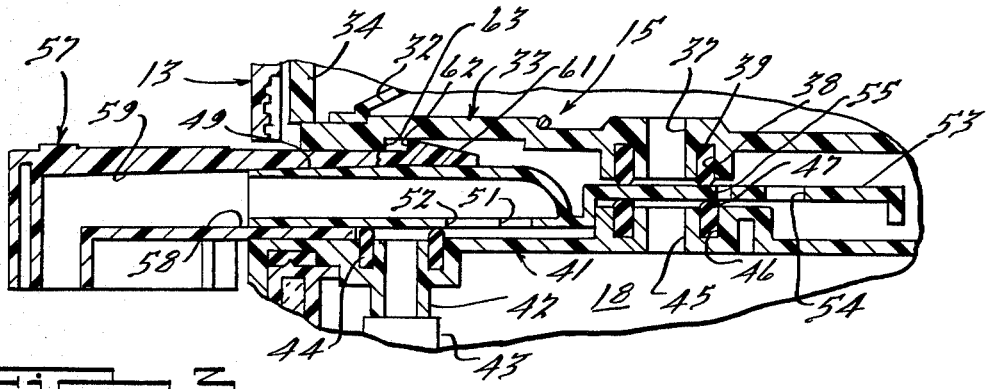
FIG. 3 is a cross sectional view, in part similar to FIG. 2 showing the dispensing valve in its closed position.
Figure 4:
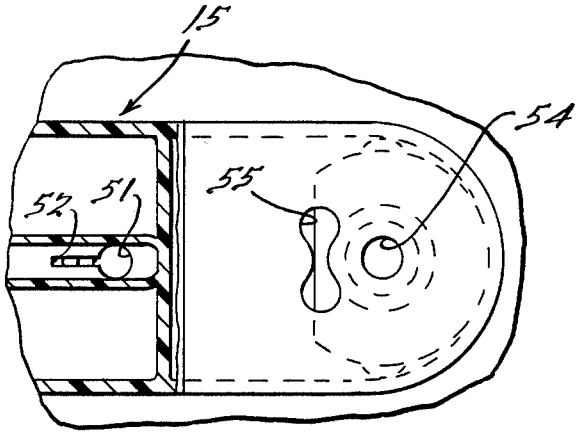
FIG. 4 is a cross sectional view taken along the line 3—3 of FIG. 2.

FIG. 3 shows the valve 15 in its closed, non-dispending position. In this position the slide valve portion 53 is interposed between the seals 39 and 47 and both the dumb-bell shaped slot 58 and the passage 54 are spaced outwardly of these seals. Any pressure on the pump actuator 29 will, therefore, not cause pressure of the area above the liquid in the cavity 18. In a like manner, both the aperture 51 and slot 52 of the slide valve 48 will be spaced outside of the area bounded by the seal 44 so that the upper end of the opening extending through the projection 42 will be closed. Thus, it will be impossible to generate air pressure above the liquid in the cavity 18 and no path of escape for the liquid in the cavity is possible, even though the container 11 may be inverted.

When it is desired to dispense liquid the spout 57 is grasped and pulled outwardly. The surface 62 of the cantilevered tab 61 will engage the plate surface 63 and stop the valve 15 in its venting position. When the valve 15 is in this venting position, the narrow slot 52 will communicate the opening in the projection 42 with the discharge passage of the discharge portion 49, albeit at a restricted rate. Thus, any pressure build up above the liquid in the tube 43 will be vented slowly to the atmosphere. At the same time, the dumb-bell shaped opening 55 will provide a restricted communication between the plate opening 45 and the opening 37 of the plate 33 on the lower end of the diaphragm 32. Any pressure which might exist above the liquid in the cavity 18 may, therefore, be vented to the atmosphere through the diaphragm 32 and normally opened check valve 36. Thus, any pressure over the liquid in the cavity 18 will be vented outwardly so as to avoid unwanted drippage from the nozzle 57.

It should be noted that the cantilevered portion 61 is normally not accessible to the operator when the valve 15 is in its closed position (FIG. 3). When the valve 15 is, however, in its vented position (FIG. 2), the outer end of the cantilever tab 61 is exposed. A user may then depress this tab, the venting by then having been accomplished, so as to draw the valve 15 outwardly to its dispensing position (FIG. 1).

In the discharge portion, the passage 37 of the plate 33 beneath the diaphragm 32 will be in registry with the passage 45 of the plate 41 that extends across the upper end of the cavity 18 through the unrestricted valve passage 54. In a like manner, the upper end of the projection 42 will be in registry with the discharge portion 49 of the valve 15 through the unrestricted opening 51. The downwardly extended opening of the spout 57 will also be position at a spaced distance from the outer surface of the wall 16 of the container 11 so that a suitable receptacle such as a cup or the like may be positioned beneath it. Depression of the pump actuator 29 will cause closure of the check valve 36 and the generation of air pressure through the openings 37, 54 and 45 above the liquid in the cavity 18. This pressure build up will cause liquid to be directed upwardly through the tube 43 and discharged through the discharge portion 49 and spout 57 into a waiting receptacle. When the actuator 29 is released, the check valve 36 will open as the spring 35 returns the diaphragm 32 to its distended position. The diaphragm chamber 32 is then charged with air for the next pumping cycle.

When a dispensing operation is completed the valve assembly 15 is closed by forcing the spout 57 and associated slide valve 48 to its closed position (FIG. 3). In this position the diaphragm cavity and discharge portion of the spout are again isolated from the liquid in the cavity 18 in the manner aforedescribed.

It is to be understood that the foregoing description is that of a preferred embodiment of the invention and various changes and modifications may be made without departing from the spirit and scope of the invention, as defined by the appended claims.

What is claimed is:

1. In a dispensing container having a body portion defining a cavity for containing a liquid, pump means carried by said body portion, said pump means having an outlet port in communication with said cavity for generating a pressure upon the liquid therein upon operation of said pump means, dispensing means for delivering liquid from said cavity upon actuation of said pump means, valve means movable between a closed position, an intermediate position and an opened position, a releasable stop means for releasably and positively restraining said valve means in its intermediate position, said valve means being effective to close communication of said outlet port with said cavity and prevent liquid passage through said dispensing means when said valve means is in its closed position, and venting means for venting the area over the liquid in said container to the atmosphere at a restricted rate when said valve means is in its intermediate position for precluding accidental leakage of fluid due to pressure build-up when said valve means is moved to its open position.

2. A container as set forth in claim 1 wherein the valve means is effectuated to vent the area above the liquid in the dispensing means to the atmosphere when the valve means is in its intermediate position.

3. A container as set forth in claim 2 wherein the valve means comprises a first valve for closing the communication of the outlet port with the cavity and a second valve for precluding flow through the dispensing means, said first and said second valves being connected to a common actuator for simultaneous opening and closing thereof.

4. A container as set forth in claim 1 wherein the valve means is supported for reciprocating movement between its open and closed positions.

5. A container as set forth in claim 2 wherein the outlet port is positioned in a lower surface of the pump means, there being a second opening disposed beneath and aligned with said outlet port, said valve means having an apertured part slidably positioned between said outlet port and said second opening when said valve means is in its opened position and non-aligned therein when said valve means is in its closed position for preventing communication between said outlet port and said second opening.

6. A container as set forth in claim 3 wherein the venting means comprises a member of a valve means that defines a substantially unrestricted opening that is disposed to permit communication when the valve means is in its opened position and means defining a restricted opening for providing restricted communication when the valve means is in its intermediate position.

7. A container as set forth in claim 6 wherein the restricted and unrestricted openings control the communication of the area communicating the pump means with the area above the liquid in the cavity.

8. A container as set forth in claim 3 wherein each of the first and second valves is provided with a substantially unrestricted opening that permits substantially unrestricted communication when the valve means is in its opened position and a restricted opening that provides restricted communication when the valve means is in its intermediate position.

* * * * *